US008133594B2

(12) United States Patent
Tachiki et al.

(10) Patent No.: US 8,133,594 B2
(45) Date of Patent: Mar. 13, 2012

(54) STEEL SHEET FOR CONTAINER USE

(75) Inventors: Akira Tachiki, Tokyo (JP); Shigeru Hirano, Tokyo (JP); Hiroshi Nishida, Tokyo (JP); Hirokazu Yokoya, Tokyo (JP); Hironobu Miyazaki, Tokyo (JP); Masakazu Noda, Tokyo (JP)

(73) Assignee: Nippon Steel Corporation, Tokyo (JP)

( * ) Notice: Subject to any disclaimer, the term of this patent is extended or adjusted under 35 U.S.C. 154(b) by 0 days.

(21) Appl. No.: 12/802,389

(22) Filed: Jun. 4, 2010

(65) Prior Publication Data

US 2011/0300402 A1 Dec. 8, 2011

(51) Int. Cl.
*B32B 15/04* (2006.01)
*B32B 15/18* (2006.01)

(52) U.S. Cl. ..... 428/633; 428/660; 428/661; 428/646; 428/648; 428/680; 428/684; 428/685; 428/332; 428/340; 428/213; 428/214

(58) Field of Classification Search ..... 428/607, 428/632, 633, 639, 660, 661, 646, 648, 680, 428/681, 684, 685, 215, 216, 219, 220, 332, 428/334, 335, 336, 340, 213, 214
See application file for complete search history.

(56) References Cited

U.S. PATENT DOCUMENTS

2004/0244875 A1* 12/2004 Yasuda et al. ..... 148/247
2005/0175798 A1* 8/2005 Kurokawa et al. ..... 428/34.1

FOREIGN PATENT DOCUMENTS

| | | |
|---|---|---|
| JP | 2000-234200 | 8/2000 |
| JP | 2000-239855 | 9/2000 |
| JP | 2002-194589 | 7/2002 |
| JP | 2004-60052 | 2/2004 |
| JP | 2005-23422 | 1/2005 |
| JP | 2005-325402 | 11/2005 |
| JP | 2009-256726 | * 11/2009 |

OTHER PUBLICATIONS

Machine Translation, Date et al., JP 2009-256726, Nov. 2009.*
Machine Translation, Yasuda et al., JP 2005-325402, Nov. 2005.*

* cited by examiner

*Primary Examiner* — Michael Lavilla
(74) *Attorney, Agent, or Firm* — Kenyon & Kenyon LLP

(57) ABSTRACT

Steel sheet for container use able to realize superior corrosion resistance and canmaking ability, wherein at least one side of the steel sheet is provided with a chemical conversion coating film including a mixture of a zirconium oxide compound and a zirconium phosphate compound, the zirconium oxide compound is segregated at part or all of a region of 40 to 100% from the surface with respect to the total thickness of the chemical conversion coating film, and the zirconium phosphate compound is segregated at part or all of a region of 0 to 40% from the surface with respect to the total thickness of the chemical conversion coating film.

11 Claims, 5 Drawing Sheets

STEEL SHEET FOR CONTAINER USE

TECHNICAL FIELD

The present invention relates to steel sheet for container use and a method of production of the same.

BACKGROUND ART

Metal containers have been used for a long time now as containers for beverages or food. As the steel material for metal containers, mainly nickel-(Ni) plated steel sheet and tin-(Sn) or Sn-alloy-plated steel sheet has been used.

To improve the rustproofing effect of plated steel sheet, in the past rustproofing by chromate using hexavalent chromic acid etc. has been widely practiced. Furthermore, in accordance with need, for the purpose of imparting resistance to organic solvents, resistance to finger marks, scratch resistance, lubricity, etc., a coating layer comprised or an organic resin has been formed over the chromate treatment coating film (see PLT 1).

In recent years, in view of the rising interest in environmental problems, attention has focused on the fact of hexavalent chrome being toxic. There is a movement trying to eliminate chromate treatment performed in the past on Ni-plated steel sheet or Sn— or Sn-alloy-plated steel sheet.

The treated coating film formed by the chromate treatment has a high corrosion resistance and lacquer adhesion, so if not performing chromate treatment, it is expected that these performances will remarkably drop.

For this reason, it has been demanded that even when slashing the amount of use of the chrome in chromate treatment of the surface of Ni-plated steel sheet or Sn— or Sn-alloy-plated steel sheet or applying an alternative rustproofing treatment to chromate treatment, a rustproofing layer having superior corrosion resistance and lacquer adhesion be formed.

To solve the above problem, a method of treatment dipping an Sn-plated steel sheet in a chemical conversion solution including phosphate ions and a silane coupling agent or coating an Sn-plated steel sheet with such a chemical conversion solution and then drying the same is disclosed (see PLT 2).

Further, a method of treating the surface of an Sn-plated steel sheet by an electrolysis reaction using a phosphate compound (see PLT 3), a method of treating the surface of an Al material by an electrolysis reaction using a titanium-based compound, etc. have been disclosed (see PLT 4).

Furthermore, not only the method of utilizing an electrolysis reaction, but also the method of cathodic electrolysis treatment using an aluminum-based, zinc-based, iron-based, and magnesium-based substrate (see PLT 5) or the method of cathodic electrolysis treatment of an Sn— or Sn-alloy-plated steel material by a chemical conversion treatment material including a zirconium (Zr)— containing compound and a fluorine-containing compound (see PLT 6) has also been disclosed.

CITATION LIST

Patent Literature

PLT 1: Japanese Patent Publication (A) No. 2000-239855
PLT 2: Japanese Patent Publication (A) No. 2004-60052
PLT 3: Japanese Patent Publication (A) No. 2000-234200
PLT 4: Japanese Patent Publication (A) No. 2002-194589
PLT 5: Japanese Patent Publication (A) No. 2005-23422
PLT 6: Japanese Patent Publication (A) No. 2005-325402

SUMMARY OF INVENTION

Technical Problem

However, the method described in PLT 2 is treatment of dipping or coating a sheet in or by a chemical conversion solution and drying the same, so the productivity is poor.

With the method of forming a surface treatment coating film by an electrolysis reaction or cathodic electrolysis treatment described in PLTs 3 to 6, realization of sufficient corrosion resistance and adhesion is difficult.

The present invention was made in consideration of such problems and has as its object the provision of steel sheet for container use having superior corrosion resistance and canmaking ability and a method of production of the same.

Solution to Problem

The inventors engaged in intensive research and as a result discovered that the corrosion resistance and canmaking ability of steel sheet are greatly influenced by the structure of the surface treatment coating film, that is, the chemical conversion coating film.

The inventors engaged in intensive research on the structure of a chemical conversion coating film and as a result discovered that by suitably dispersing a zirconium oxide compound and zirconium phosphate compound in a chemical conversion coating film including an zirconium oxide compound and zirconium phosphate compound, steel sheet having superior corrosion resistance and canmaking ability can be obtained.

The present invention was completed based on such discoveries. The gist of the present invention is as follows.

(1) Steel sheet for a container provided with a chemical conversion coating film including a mixture of a zirconium oxide compound and a zirconium phosphate compound at one surface or both surfaces of the steel sheet, the steel sheet for container use characterized in that the zirconium oxide compound is segregated, with respect to a thickness of the chemical conversion coating film, at part or all of a region of a depth of 40 to 100% from the surface and the zirconium phosphate compound is segregated, with respect to a thickness of the chemical conversion coating film, at part or all of a region of a depth of 0 to 40% from the surface.

(2) Steel sheet for container as set forth in (1), characterized in that the chemical conversion coating film contains, in amount of metal zirconium, 1 to 9 $mg/m^2$ of zirconium.

(3) Steel sheet for container as set forth in (1) or (2), characterized in that the chemical conversion coating film contains, in amount of phosphorus, 0.5 to 8 $mg/m^2$ of phosphoric acid.

(4) Steel sheet for container as set forth in (1) or (2), characterized by being provided, between the steel sheet and the chemical conversion coating film, with an inner plating containing at least nickel or tin.

(5) Steel sheet for container as set forth in (3), characterized by being provided, between the steel sheet and the chemical conversion coating film, with an inner plating containing at least nickel or tin.

(6) Steel sheet for container as set forth in (4), characterized in that the inner plating is nickel plating, and the nickel plating contains, in amount of metal nickel, 150 to 1000 $mg/m^2$ of nickel.

(7) Steel sheet for container as set forth in (5), characterized in that the inner plating is nickel plating, and the nickel plating contains, in amount of metal nickel, 150 to 1000 mg/m$^2$ of nickel.

(8) Steel sheet for container as set forth in (4), characterized in that the inner plating is tin plating, and the tin plating contains, in amount of metal tin, 560 to 5600 mg/m$^2$ of tin.

(9) Steel sheet for container as set forth in (5), characterized in that the inner plating is tin plating, and the tin plating contains, in amount of metal tin, 560 to 5600 mg/m$^2$ of tin.

(10) Steel sheet for container as set forth in (4), characterized in that the inner plating is provided with a nickel plating or iron-nickel alloy plating and, further, a tin plating applied over the nickel plating or the iron-nickel alloy plating, part or all of the nickel plating or the iron-nickel alloy plating and part of the tin plating are alloyed to form tin alloy plating containing islands of tin, and the inner plating contains nickel, in amount of metal nickel, of 5 to 150 mg/m$^2$ and tin, in amount of metal tin, of 300 to 3000 mg/m$^2$.

(11) Steel sheet for container as set forth in (5), characterized in that the inner plating is provided with a nickel plating or iron-nickel alloy plating and, further, a tin plating applied on the nickel plating or the iron-nickel alloy plating, part or all of the nickel plating or the iron-nickel alloy plating and part of the tin plating are alloyed to form tin alloy plating containing islands of tin, and the inner plating contains nickel, in amount of metal nickel, of 5 to 150 mg/m$^2$ and tin, in amount of metal tin, of 300 to 3000 mg/m$^2$.

Advantageous Effects of Invention

According to the present invention, it becomes possible to produce steel sheet for container use having superior corrosion resistance and canmaking ability.

DESCRIPTION OF EMBODIMENTS

Below, preferred embodiments of the present invention will be explained in detail while referring to the attached drawings.

Figure 1A:
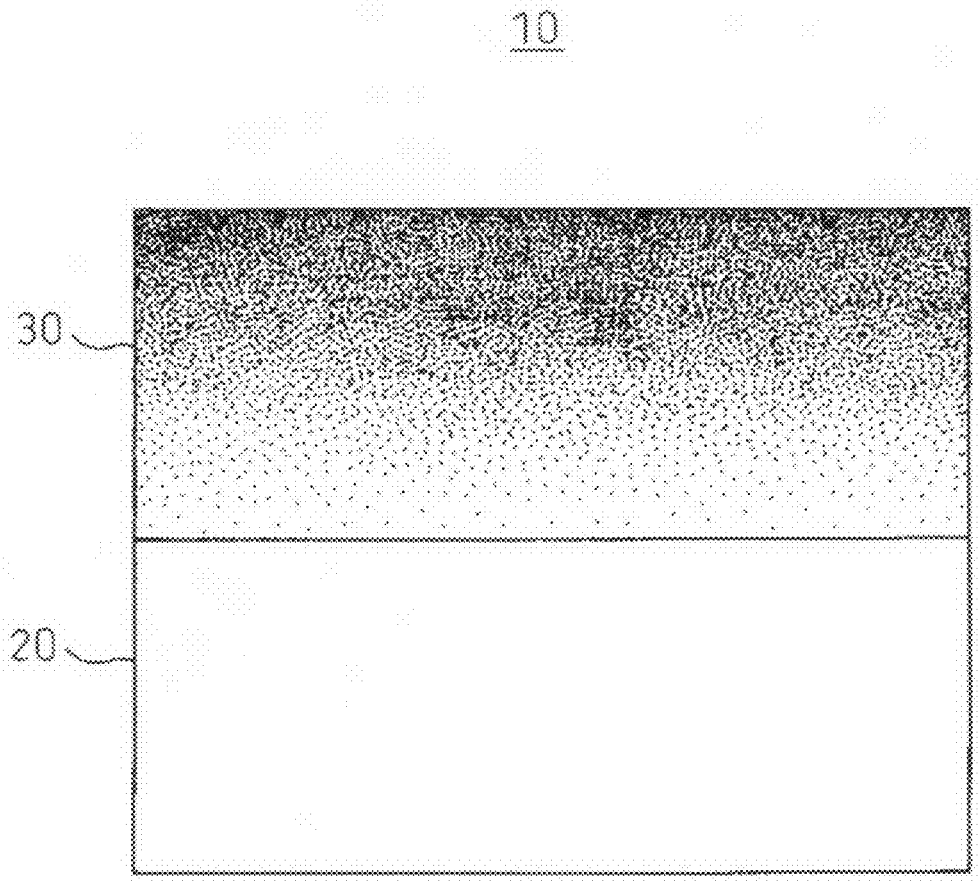
FIG. 1A is a view explaining in brief one example of the constitution of a steel sheet for container use of the present invention.
Figure 1B:
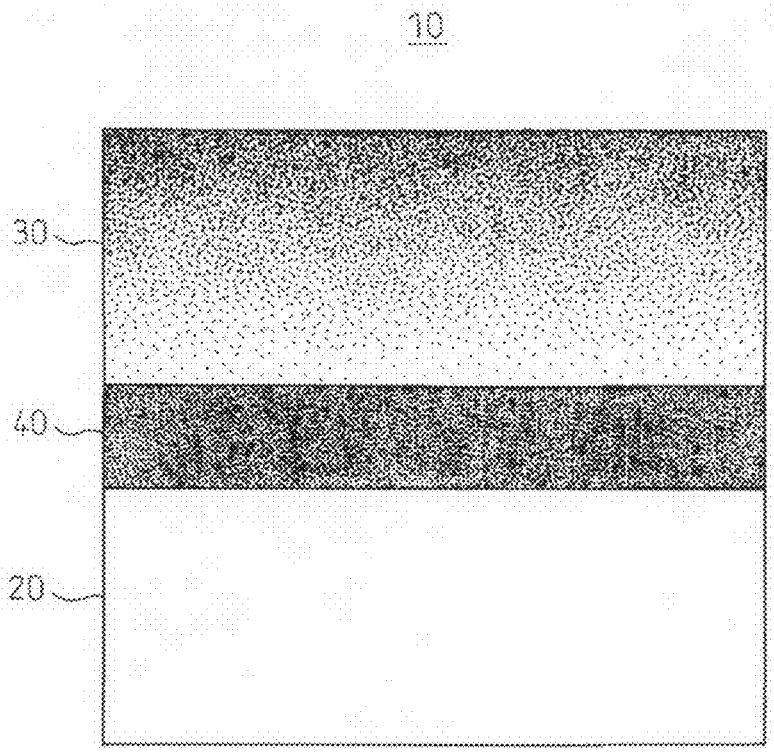
FIG. 1B is a view explaining in brief another example of the constitution of a steel sheet for container use of the present invention.

FIG. 1A and FIG. 1B explain in brief the constitution of the steel sheet for container use of the present invention.

A steel sheet for container use 10, as shown in FIG. 1A, is provided with a steel sheet 20 used as the base sheet and a chemical conversion coating film 30 formed on at least one surface of the steel sheet 20.

The base sheet used in the present invention is not particularly limited. Any steel sheet normally used as a container material can be used.

The method of production and material grade of the steel sheet are not particularly limited. For example, the steel sheet can be produced by producing a slab by the usual production process, then hot rolling, pickling, cold rolling, annealing, temper rolling it, etc.

As shown in FIG. 1B, the surface of the steel sheet 20 may, for example, be formed with an inner plating 40 comprised of a metal.

The method of forming the inner plating 40 used may be a known method, for example, electroplating, vapor deposition, or sputtering. The method of forming the inner plating 40 is not limited to the above example.

(Regarding Chemical Conversion Coating Film 30)

The chemical conversion coating film 30 of the present invention, as shown in FIG. 1A and FIG. 1B, is formed on the steel sheet 20 or inner plating 40. As the components for forming the chemical conversion coating film 30, for example, a zirconium component and phosphate component may be mentioned.

When the zirconium component or phosphoric acid component forms a chemical conversion coating film 30 as an independent zirconium coating film or phosphoric acid coating film, the corrosion resistance and the adhesion can be improved to a certain extent, but a sufficiently practical performance cannot be obtained.

By making the chemical conversion coating film 30 a composite coating film of a zirconium component and a phosphate component combined together like in the chemical conversion coating film 30 of the present invention, a superior performance can be obtained.

The chemical conversion coating film 30 may be formed on both surfaces of the steel sheet 20 or may be formed on only one surface.

<Regarding Zirconium Component>

The zirconium component included in the chemical conversion coating film 30 has the function of improving the corrosion resistance, lacquer and other adhesion, and processing adhesion of the steel sheet. The zirconium component, for example, is comprised of a plurality of zirconium compounds such as zirconium oxide, zirconium phosphate, zirconium hydroxide, zirconium fluoride, etc.

The advantageous effect of the zirconium component of improving the corrosion resistance, the lacquer and other adhesion, and the processing adhesion becomes larger the greater the amount of the zirconium component included in the chemical conversion coating film 30.

Specifically, to improve the corrosion resistance, lacquer and other adhesion, and processing adhesion, the zirconium component contained in the chemical conversion coating film 30 is preferably, converted to the amount of metal Zr, at least 1 mg/m$^2$.

However, if the content of the zirconium component, converted to the amount of metal Zr, exceeds 9 mg/m$^2$, the coating film derived from the zirconium component will become too thick, so the adhesion of the chemical conversion coating film itself will fall due mainly to cohesive failure and the electrical resistance will rise resulting in a drop in weldability of the steel sheet for container use. Furthermore, uneven deposition of the chemical conversion coating film sometimes appears as uneven appearance.

Therefore, in the steel sheet for container use of the present invention, the content of the zirconium component in the chemical conversion coating film is preferably, converted to amount of metal Zr, 1 $mg/m^2$ to 9 $mg/m^2$. From the viewpoint of the corrosion resistance after retort processing and the reduction of fine unevenness in deposition, it is more preferably 2 $mg/m^2$ to 6 $mg/m^2$.

<Regarding Phosphate Component>

The chemical conversion coating film 30 includes, in addition to the zirconium component, a phosphate component comprised of one or more types of phosphate compounds.

The phosphate component has the function of improving the corrosion resistance, lacquer and other adhesion, and processing adhesion of the steel sheet. The phosphate component is comprised of a compound formed by reacting with the inside layer (steel sheet, Ni plating, composite plating, or Sn plating) or with the zirconium component such as iron phosphate, nickel phosphate, tin phosphate, zirconium phosphate or other single type of phosphate compound or a composite component comprised of two or more these types of phosphate compounds.

The advantageous effect of improvement of the corrosion resistance, lacquer and other adhesion, and processing adhesion becomes greater the great the amount of the phosphoric acid component.

Specifically, to improve the corrosion resistance, lacquer or other adhesion, and processing adhesion, the content of the phosphate component in the chemical conversion coating film 30 is preferably, converted to amount of P, 0.5 $mg/m^2$ or more.

However, if the content of the phosphoric acid component, converted to amount of P, exceeds 8 $mg/m^2$, the coating film derived from the phosphoric acid component will become too thick, so the adhesion of the chemical conversion coating film itself will fall mainly due to cohesive failure and the electrical resistance will rise resulting in a drop in the weldability of the steel sheet for container use. Furthermore, the uneven deposition of the chemical conversion coating film will sometimes appear as uneven appearance.

Therefore, in the steel sheet for container use of the present invention, the content of the phosphate component in the chemical conversion coating film is preferably, in amount of P, 0.5 $mg/m^2$ to 8 $mg/m^2$. From the viewpoint of the corrosion resistance after retort processing and the reduction of fine unevenness in deposition, it is more preferably 1 $mg/m^2$ to 5 $mg/m^2$.

<Regarding Method of Measurement of Contents of Components in Chemical Conversion Coating Film>

The amount of metal Zr and the amount of P contained in the chemical conversion coating film 30, for example, can be measured by fluorescent X-ray analysis or another quantitative analysis method.

<Regarding Coating Film Structure of Chemical Conversion Coating Film 30>

Figure 2:
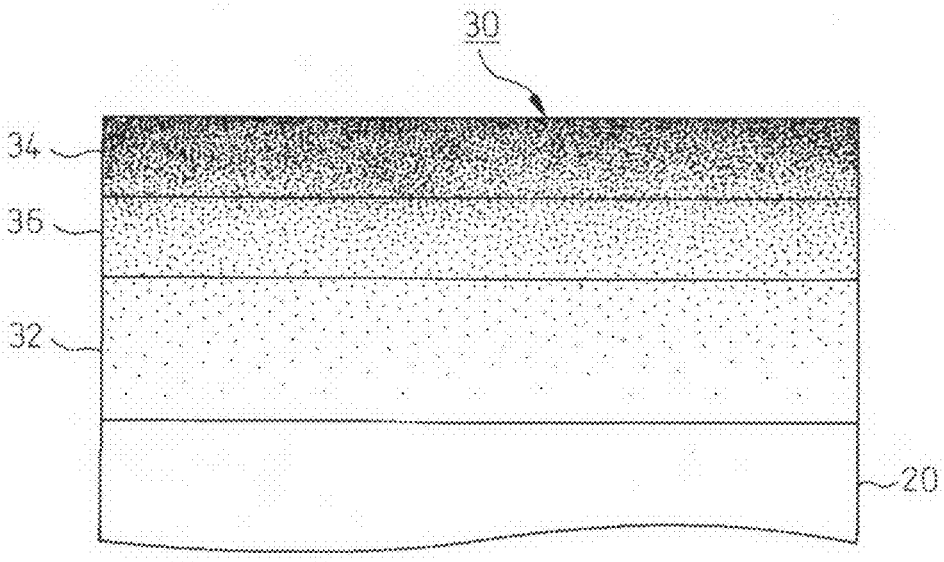
FIG. 2 is a view explaining in brief a chemical conversion coating film of a steel sheet for container use of the present invention.

FIG. 2 is a view explaining in brief the coating film structure of the chemical conversion coating film 30 according to the present invention.

The coating film structure of the chemical conversion coating film 30 splits the functions among the components forming the chemical conversion coating film 30, that is, the zirconium oxide compound and the zirconium phosphate compound. The zirconium oxide compound is segregated at part or all of a region of a depth of 40 to 100% from the top surface (surface at opposite side to inside layer, same below) with respect to the total thickness of the chemical conversion coating film 30, while the zirconium phosphate compound is segregated at part or all of a region of a depth of 0 to 40% from the top surface with respect to the total thickness of the chemical conversion coating film 30.

Below, the region where the zirconium oxide compound segregates will be called the "oxide compound layer", while the region where the zirconium phosphate compound segregates will be called the phosphate layer. Further, the region positioned between the oxide compound layer and the phosphate layer where the zirconium oxide compound and the zirconium phosphate compound are copresent will be called the "copresence layer".

Here, when a certain type of element segregates, a peak showing the presence of that type of element will be a peak of a height of at least two times the maximum noise height in the spectral chart obtained by XPS analysis. Details will be explained later.

In FIG. 2, the interface between the oxide compound layer 32 and the copresence layer 36 and the interface between the copresence layer 36 and the phosphate layer 34 are not clearly defined. The layer structure changes continuously from the oxide compound layer 32 to the copresence layer 36. Further, the layer structure changes continuously from the copresence layer 36 to the phosphate layer 34.

The existence in the chemical conversion coating film 30 of the phosphate layer 34 and the copresence layer 36 means that the zirconium phosphate compound is present in the chemical conversion coating film 30 with a certain distribution. That is, most of the zirconium phosphate compound present in the chemical conversion coating film 30 is segregated in the phosphate layer 34. This means that the more from the copresence layer 36 to the oxide compound layer 32, the smaller the content of the zirconium phosphate compound.

The total thickness of the chemical conversion layer, the thicknesses of the individual layers, and the ratios of the thicknesses can be identified based on values converted to $SiO_2$ in X-ray photoelectron spectroscopy (XPS).

The method of measurement of the thickness of the layers according to the present invention is limited to the values obtained using the above method. That is, the absolute values do not show accurate values in the strict sense. However, the structure of the chemical conversion coating film 30 is still comprised of the oxide compound layer 32 positioned at the steel sheet 20 side, the phosphate layer 34 positioned at the surface side of the chemical conversion coating film 30, and the copresence layer 36 positioned between the oxide compound layer 32 and the phosphate layer 34, that is, the positions of formation of the different layers of the coating film layers and the order of arrangement of the coating film layers remain unchanged.

The oxide compound layer 32 is the layer where the zirconium oxide compound segregates. Here, the zirconium oxide compound may also be a zirconium-n-hydrate expressed by $ZrO_2.nH_2O$ and may also be a zirconium oxide anhydride expressed by $ZrO_2$.

The oxide compound layer 32, as shown in FIG. 2, is present at the steel sheet 20 side. The oxide compound layer 32 is believed to form a dense matrix and imparts a superior corrosion resistance and adhesion between the chemical conversion coating film 30 and the steel sheet 20.

The oxide compound layer 32 is present in the region of a depth of 40 to 100% from the surface of the chemical conversion coating film. In particular, it is important that the oxide compound layer 32 be present contiguous with the steel sheet 20.

When the oxide compound layer 32 is not present contiguous with the steel sheet, the function borne by the oxide compound layer, that is, the superior corrosion resistance, and the adhesion between the chemical conversion coating film 30 and the steel sheet 20, drop.

The oxide compound layer 32 may also have present in it, in a content of within 10%, in addition to a zirconium oxide compound, for example, a zirconium phosphate compound or may have another compound present in it.

The phosphate layer 34 is a layer in the chemical conversion coating film 30 in which the zirconium phosphate compound is present in a large amount. The zirconium phosphate compound is a zirconium phosphate hydrate expressed by $Zr_3(PO_4)_4.mH_2O$, $Zr(HPO_3)_2.nH_2O$, etc.

The phosphate layer 34 is present at the top surface side of the chemical conversion coating film 30. The phosphate layer 34 imparts a superior corrosion resistance and adhesion between the chemical conversion coating film 30 and the paint or film formed on the chemical conversion coating film 30.

It is important that the phosphate layer 34 be present in a region of a depth of 0 to 40% from the top surface of the chemical conversion coating film 30. In particular, it is preferably present at the topmost surface of the chemical conversion coating film 30.

When there is no phosphate layer 34 present at the topmost surface, the function borne by the phosphate layer, that is, the superior corrosion resistance, and the adhesion between the chemical conversion coating film 30 and the paint or film formed on the chemical conversion coating film 30 fall.

The phosphate layer 34 may also have present in it, in a content of within 10%, in addition to the zirconium phosphate compound, for example, a zirconium oxide compound or may have another compound present in it.

The copresence layer 36 is a layer positioned between the oxide compound layer 32 and the phosphate layer 34 and is a layer in which the zirconium oxide compound and the zirconium phosphate compound are copresent.

The copresence layer 36 may also have another compound other than the zirconium oxide compound and the zirconium phosphate compound present in it.

The fact of the chemical conversion coating film 30 of the present invention having a layer structure as explained above can be confirmed from the results of analysis of the state of composition including analysis of the depth direction of the chemical conversion coating film by X-ray photoelectron spectroscopy (XPS).

Figure 3A:
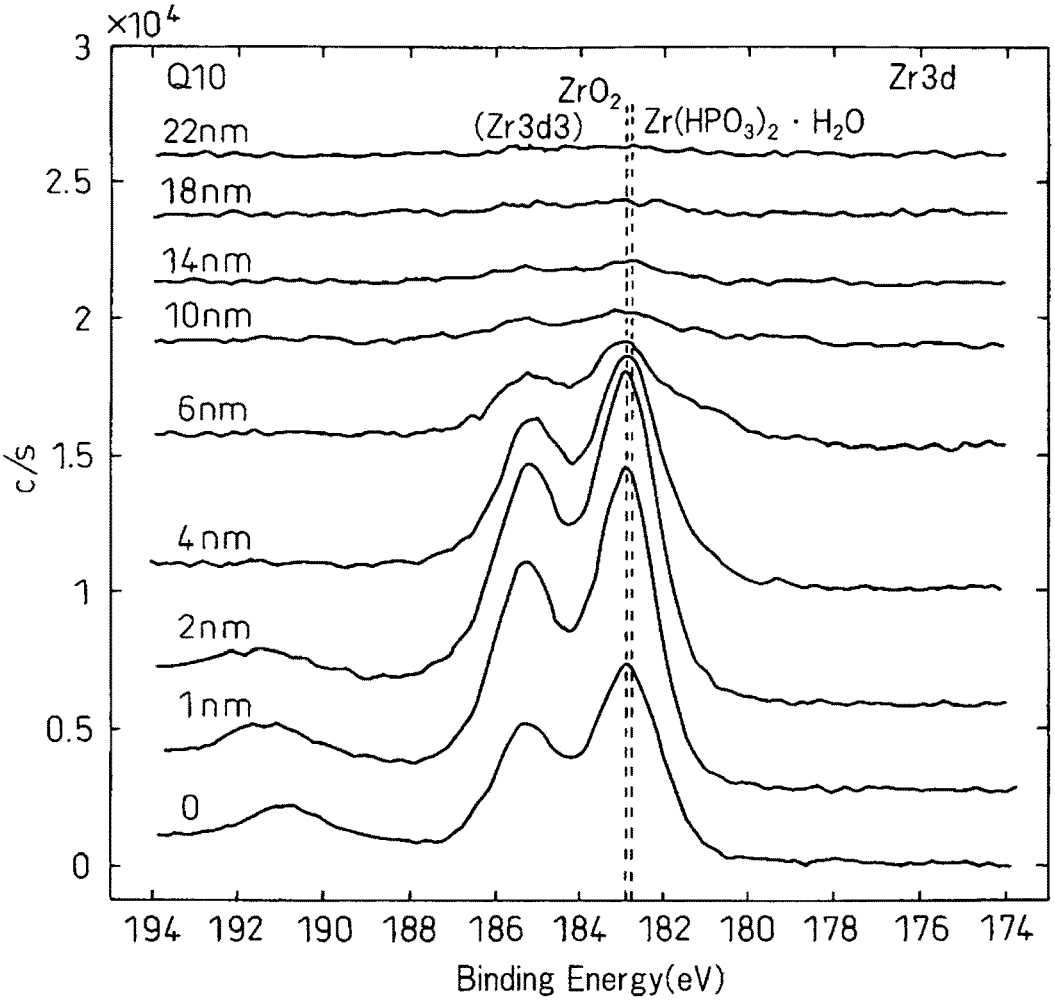
FIG. 3A is a view showing results of measurement of the XPS spectrum focusing on the zirconium of a chemical conversion coating film of a steel sheet for container use of the present invention.
Figure 3B:
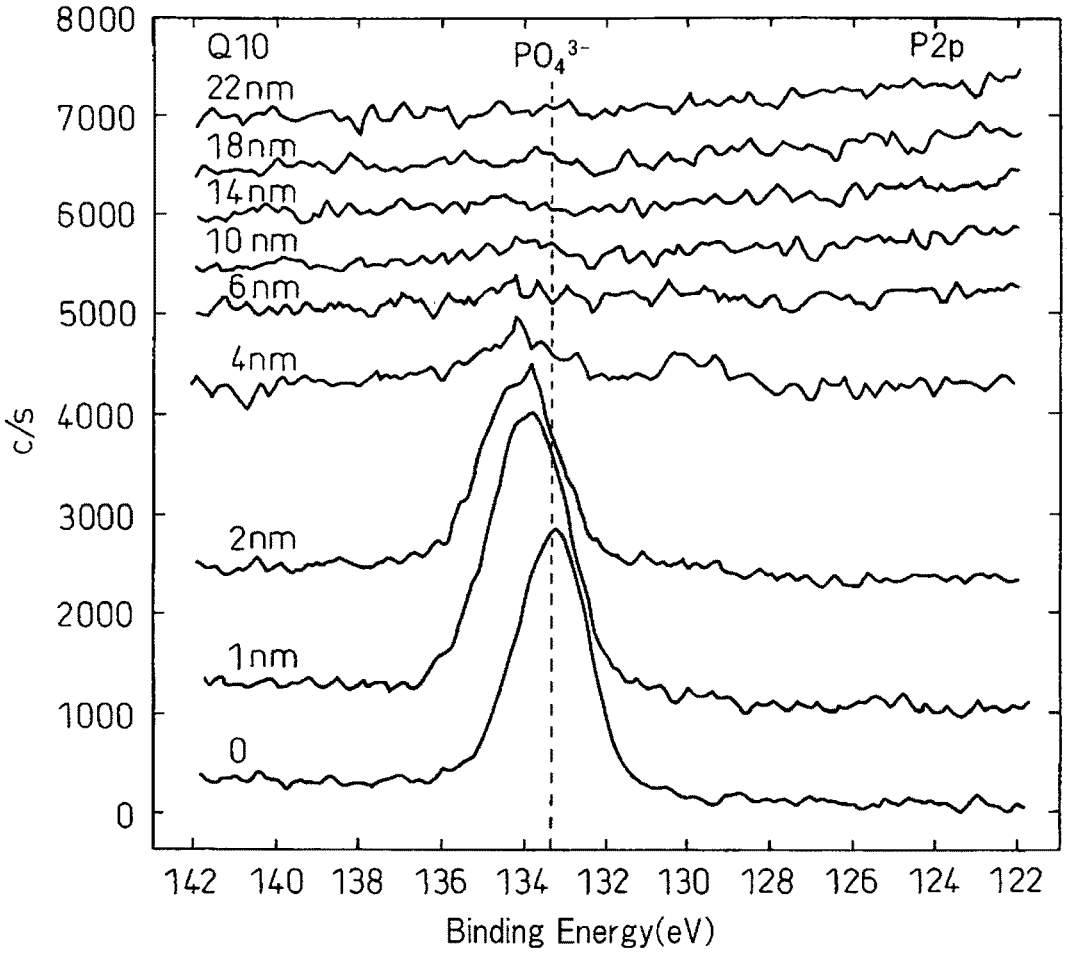
FIG. 3B is a view showing results of measurement of the XPS spectrum focusing on the phosphorus of a chemical conversion coating film of a steel sheet for container use of the present invention.
Figure 3C:
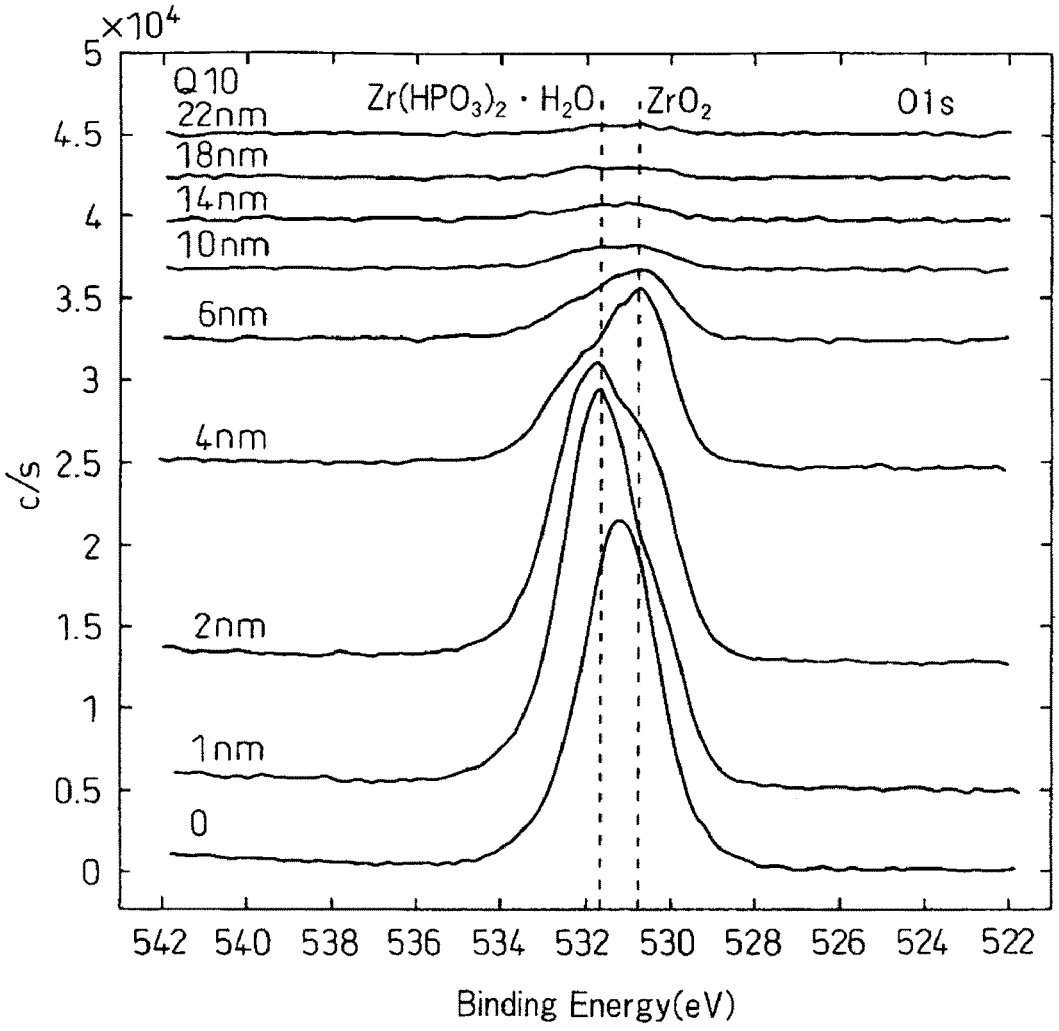
FIG. 3C is a view showing results of measurement of the XPS spectrum focusing on the oxygen of a chemical conversion coating film of a steel sheet for container use of the present invention.

FIG. 3A to FIG. 3C are examples of the results of measurement of the XPS spectrum of the chemical conversion coating film 30 and are XPS spectra in the case where the chemical conversion coating film 30 is formed to about 15 nm (measurement value of any part by observation by TEM).

The values of 0 to 22 nm described in FIG. 3A to FIG. 3C show the measurement depth (value converted to $SiO_2$) of the chemical conversion coating film 30 at which the XPS spectrum is noted when the surface of the chemical conversion coating film 30 is defined as 0 nm.

The XPS spectrum was measured by the measurement apparatus and under the measurement conditions shown in Table 1. For analysis of the obtained XPS spectrum, a MultiPak V.8.0 (made by Ulvac-phi) was used. Further, the energy of the obtained XPS spectrum was corrected so that the bonding energy became C1s=284.8 eV. Below, the depths which the XPS data shows are all converted to $SiO_2$.

TABLE 1

| Apparatus | Model Quantum 2000 XPS analysis apparatus made by PHI | |
|---|---|---|
| Measurement conditions | X-ray source | AlKα: 1486.6 eV |
| | X-ray output | 15 kV, 25 W |
| | Measurement region | 100 μmϕ |
| | Analysis chamber vacuum degree | $3.6 \times 10^{-7}$ Pa |
| | Sputtering speed (converted to $SiO_2$ ) | 17.6 nm/min |

In the present invention, if there is a certain type of element present, in the spectral chart obtained by XPS analysis focused on the element (baseline corrected by Shirley method, narrow scan), a peak of a height 1.5 times or more than the maximum noise height in the spectral chart is shown.

Further, if a certain element is segregated, in the spectral chart obtained by XPS analysis focused on that element (baseline corrected by Shirley method, narrow scan), a peak of a height 2 times or more than the maximum noise height in the spectral chart is shown.

FIG. 3A shows the XPS spectrum focusing on zirconium. In the spectrum when measuring the depth of 0 (surface of chemical conversion coating film 30) to 18 nm, a peak due to zirconium is observed, while in the spectrum measuring the depth of 22 nm, a peak due to zirconium is not observed. This shows that zirconium is present from the surface of the chemical conversion coating film 30 down to near about 18 nm. This shows that at locations deeper than about 18 nm, zirconium is only present in a concentration of less than the measurement limit of the XPS. That is, this shows that the thickness of the chemical conversion coating film 30 is about 18 nm.

FIG. 3B is an XPS spectrum focusing on phosphorous. In the spectrum measuring the depth of 0 to 4 nm, a peak derived from phosphate ions is observed. In the spectrum measuring the depth of 6 nm, the intensity of the peak derived from the phosphate ions is about the same extent as the intensity of the background. No peak derived from phosphate ions is therefore observed.

This result shows that in the chemical conversion coating film 30 shown in FIG. 3B, there are phosphate ions present from the surface down to about close to 4 nm, but that deeper than about 6 nm, phosphate ions are only present in a concentration below the measurement limit of XPS.

FIG. 3C is an XPS spectrum focusing on oxygen. In the spectrum measuring the depth of 0 to 10 nm, a peak of oxygen derived from phosphate ions is observed. In the spectrum measuring the depth of 2 to 18 nm, a peak of oxygen derived from phosphate ions is observed. In the spectrum measuring the depth of 22 nm, no peak derived from oxygen is observed.

This result shows that there is oxygen derived from phosphate ions present from the surface down to about close to 6 nm and that from about 2 nm to close to about 18 nm, oxygen derived from zirconium oxide compounds are present. Further, deeper than about 22 nm, oxygen ions are only present in a concentration below the measurement limit of XPS.

From the results of measurement of the XPS spectrum shown in FIG. 3A to FIG. 3C, it is learned that, in the chemical conversion coating film 30 of the present example of measurement, there is a large amount of the zirconium phosphate compound present from the surface to close to about 6 nm (in the case of the present sample, about 33% or so of the depth direction), while the zirconium oxide compound is segregated at 4 nm to 18 nm or so (about 22% to 100% of the depth direction). In the case of the present sample, from about 4 nm to close to about 6 nm, it is guessed that the phosphate compound and oxide compound are copresent.

In this way, in the chemical conversion coating film 30 of the present invention, the zirconium oxide compound and zirconium phosphate compound are not uniformly present. The zirconium phosphate compound is present in the chemical conversion coating film 30 with a specific distribution and is segregated at the surface of the chemical conversion coating film 30 and near the surface.

By having such a configuration of a coating film, the steel sheet for container use of the present invention has a superior corrosion resistance and canmaking ability.

[Regarding Method of Production of Chemical Conversion Coating Film]

Next, the method of production for producing the steel sheet for container use of the present invention will be explained in detail.

The steel sheet for container use of the present invention is produced by treating a steel sheet by low temperature cathodic electrolysis, then forming the above-mentioned chemical conversion coating film on at least one surface of the steel sheet.

The chemical conversion coating film of the present invention has a layer structure comprised of, in order from the steel sheet side, an oxide compound layer, a copresence layer, and a phosphate layer. For forming this structure, an acidic solution in which zirconium ions and phosphate ions are dissolved is used to treat the steel sheet or steel sheet given an inner plating by cathodic electrolysis. According to the cathodic electrolysis, it is possible to form a chemical conversion coating film having the above such layer structure by a single process.

As the method for forming the chemical conversion coating film on the steel sheet, the method of dipping the steel sheet in a chemical conversion solution may also be used. However, with a method using dipping, the layer under the chemical conversion coating film such as the steel sheet or inner plating is etched and various coating films are formed on the result, so the thickness of the chemical conversion coating film becomes uneven and a chemical conversion coating film having a layer structure becomes hard to form. Further, the treatment time required for forming the chemical conversion coating film also becomes longer, so this is disadvantageous industrially.

In the method using cathodic electrolysis, due in part to the powerful charge movement and the surface normalization and rise in hydrogen ion concentration (pH) due to the generation of hydrogen at the steel sheet interface and the resultant effect of promotion of adhesion, a uniform coating film can be formed in a short time frame of 0.01 second to several seconds. For this reason, the method using cathodic electrolysis is a method which is extremely advantageous industrially. Therefore, the chemical conversion coating film of the present invention is preferably formed by cathodic electrolysis.

To use cathodic electrolysis to form a chemical conversion coating film, a chemical conversion solution comprised of a predetermined ratio of the zirconium component and phosphate component dissolved together is used. Specifically, it is possible to use a chemical conversion solution comprised of an acidic solution containing zirconium ions in 100 to 7500 ppm and phosphate ions in 50 to 5000 ppm. The chemical conversion solution may, if necessary, also have other components added to it.

(Regarding Conditions for Performing Cathodic Electrolysis)

Regarding the cathodic electrolysis, it is preferable to perform low temperature cathodic electrolysis using a 10° C. to 40° C. chemical conversion solution for electrolysis.

By making the chemical conversion solution 40° C. or less and applying cathodic electrolysis, it is possible for form a dense, uniform coating film structure made of extremely fine-sized particles.

If making the solution temperature less than 10° C., the efficiency of formation of the coating film becomes poorer. Furthermore, when the outside air temperature is high, the chemical conversion solution has to be cooled, so this is not economical.

If making the solution temperature over 40° C., the coating film structure formed becomes uneven, so defects, fissures, microcracks, etc. are formed and formation of a dense coating film becomes difficult. Further, these form starting points of corrosion etc., so are not preferable.

When using cathodic electrolysis to form a chemical conversion coating film, the electrolytic current density is preferably made 0.05 A/dm$^2$ to 50 A/dm$^2$.

When the current density is less than 0.05 A/dm$^2$, this invites a drop in the contents of zirconium and phosphoric acid in the chemical conversion coating film and makes formation of a stable coating film difficult. The corrosion resistance and canmaking ability of the steel sheet for container use fall, so this is not preferable.

When the current density is over 50 A/dm$^2$, the contents of zirconium and phosphoric acid in the chemical conversion coating film exceed the required amounts. In some cases, insufficiently adhered coating film is washed away (peeled off) by the washing step using rinsing etc. after the electrolytic chemical conversion, so this is not economical. Further, a rise in the solution temperature of the chemical conversion solution used for the cathodic electrolysis is invited and as a result, to maintain the temperature conditions of the low temperature cathodic electrolysis, the chemical conversion solution has to be cooled, so this is not preferable.

The cathodic electrolysis is preferably performed by a current carrying time of 0.01 second to 5 seconds.

If the current carrying time is less than 0.01 second, a drop in the content of the coating film is invited and the corrosion resistance, the lacquer adhesion, etc. sometimes fall.

If the current carrying time exceeds 5 seconds, the contents of the zirconium and phosphoric acid in the coating film will exceed the required amounts. In some cases, insufficiently adhered coating film is washed away (peeled off) by the washing step using rinsing etc. after the electrolytic chemical conversion, so this is not economical. Further, a rise in the temperature of the electrolytic solution is invited and to maintain the temperature conditions of the low temperature cathodic electrolysis, the chemical conversion solution has to be cooled, so this is not preferable.

By applying cathodic electrolysis by the above-mentioned electrolytic current density and current carrying time, it is possible to form a coating film containing suitable amounts of Zr and phosphoric acid on the surface of a steel sheet.

If the chemical conversion solution contains a predetermined concentration or more of zirconium ions, it is possible to form a chemical conversion coating film containing, by amount of metal Zr, 1 mg/m$^2$ to 9 mg/m$^2$ content of Zr.

If the chemical conversion solution contains a predetermined concentration or more of phosphate ions, it is possible to form a chemical conversion coating film containing, by amount of P, 0.5 mg/m$^2$ to 8 mg/m$^2$ content of phosphoric acid.

The steel sheet on at least one surface of which an inner plating is formed may also be treated by the above low temperature cathodic electrolysis. In this case, the chemical conversion coating film is formed on the inner plating.

When forming a chemical conversion coating film, the acidic solution used for the low temperature cathodic electrolysis may further have tannic acid added to it. By adding tannic acid into the acidic solution, during the low temperature cathodic electrolysis, the tannic acid reacts with the iron (Fe) in the steel sheet and forms a coating film of iron tannate on the surface of the steel sheet. A coating film of iron tannate improves the rustproofness and adhesion, so it is also possible to form the chemical conversion coating film in an acidic solution to which tannic acid has been added according to need.

The solvent of the acidic solution used for formation of the chemical conversion coating film is not particularly limited. For example, distilled water etc. may be used. The solvent of the acidic solution may be suitably selected in accordance with the material dissolved, method of formation, conditions of formation of the chemical conversion coating film, etc.

In the chemical conversion solution, for example, it is possible to use a zirconium complex like $H_2ZrF_6$ as a source of supply of zirconium. The zirconium in the zirconium complex is becomes present in the chemical conversion solution as $Zr^{4+}$ due to the rise in pH at the cathodic electrode interface. The zirconium ions further react in the chemical conversion solution to become $ZrO_2$, $Zr_3(PO_4)_4$, or other compounds to enable the formation of the zirconium coating film.

To adjust the pH of the chemical conversion solution, for example, nitric acid, ammonia water, etc. may also be added.

The layer structure of the chemical conversion coating film may be similarly formed not only by running the steel sheet between the electrodes once in the treatment tank for the cathodic electrolysis (single pass treatment), but also by running it through it several times for the electrolysis (multipass treatment).

Regarding Inner Plating

Example 1

Ni Plating

The inner plating formed on the surface of the steel sheet can, for example, be plated with Ni.

The Ni plating is provided to improve the lacquer adhesion, film adhesion, corrosion resistance, and weldability of the steel sheet. Ni is high corrosion resistance metal, so by forming an Ni plating on the surface of the steel sheet, it is possible to improve the corrosion resistance of the steel sheet for container use.

The method of forming the Ni plating is not particularly limited. A known method, for example, vapor deposition, sputtering, or electroplating or electroless plating or other wet type plating etc. may be used. It is also possible to alloy part of the Ni with the Fe in the steel sheet to provide an Fe—Ni alloy plating.

The effect of Ni on improving the lacquer adhesion, film adhesion, corrosion resistance, and weldability is manifested if the amount of metal Ni in the Ni plating is 10 mg/m$^2$ or more and increases the greater the amount of metal Ni.

To obtain a sufficient lacquer adhesion, film adhesion, corrosion resistance, and weldability, the content of Ni in the Ni plating is preferably 150 mg/m$^2$ or more.

Further, the content of Ni in the Ni plating is preferably not more than 1000 mg/m$^2$. When the content of the Ni in the Ni plating is over 1000 mg/m$^2$, the advantageous effect of improvement of the lacquer adhesion, film adhesion, corrosion resistance, and weldability is saturated. Further, Ni is an expensive metal, so over 1000 mg/m$^2$ of plating of Ni is economically disadvantageous.

Note that the Ni plating referred to here may be formed by pure Ni or may be formed by an Ni alloy.

For the purpose of improving the mechanical strength, the steel sheet may also be nitrided. Both when the Ni plating is formed by pure Ni and when it is formed by an Ni alloy, the advantageous effect obtained by the nitriding of resistance to crushing or deformation even when the steel sheet is thin is not reduced.

After forming the Ni plating, for the purpose of further improving the corrosion resistance, it is also possible to perform heat treatment for forming a diffusion layer.

When using diffusion plating to form an Ni plating, after the surface of the steel sheet is plated with Ni, diffusion treatment is performed in an annealing furnace to form a diffusion layer. Nitriding may be performed before or after this diffusion treatment or simultaneously with the diffusion treatment.

Example 2

Sn Plating

The inner plating formed on the surface of the steel sheet can be made an Sn plating.

Sn, as explained above, gives a steel sheet superior workability, weldability, and corrosion resistance. To obtain sufficient corrosion resistance by Sn plating alone, the amount of metal Sn is preferably made 560 mg/m$^2$ or more.

The greater the amount of metal Sn, the better the corrosion resistance, but in the case of Sn plating alone, if the amount of metal Sn exceeds 5600 mg/m$^2$, the advantageous effect of improvement of the corrosion resistance becomes saturated. For this reason, from the economic viewpoint, when using an Sn plating alone, the amount of metal Sn is preferably made 5600 mg/m$^2$ or less.

By applying tin melting treatment after the Sn plating, it is possible to form an Fe—Sn alloy with the Fe in the steel sheet, better improve the corrosion resistance, improve the surface appearance, and impart a mirror surface appearance. The tin melting treatment is performed so as to melt the Sn and alloy it with the steel sheet to thereby form an Sn—Fe alloy, improve the corrosion resistance, and form islands of Sn alloy. The islands of Sn alloy can be formed by suitably controlling the tin melting treatment.

Due to the application of the tin melting treatment, it is possible to produce a steel sheet having a plating structure with no metal Sn present, superior in paint and film adhesion, and with Sn—Fe alloy plating exposed.

Example 3

Composite Plating Containing Ni and Sn

The inner plating formed on the surface of the steel sheet can be made a composite plating including Ni and Sn.

The composite plating is comprised of an Ni plating comprised of Ni or Fe—Ni formed on the surface of the steel sheet and having an amount of metal Ni of preferably 5 to 150 mg/m$^2$ and an Sn plating formed on the Ni plating and having an amount of metal Sn of preferably 300 to 3000 mg/m$^2$. The Sn plating is, due to tin melting treatment, at least partially alloyed with the Ni in the Ni plating resulting in an alloy including islands of tin.

An Ni-based plating comprised of Ni or an Fe—Ni alloy is formed so as to improve the lacquer adhesion, film adhesion, corrosion resistance, and weldability of the steel sheet. The effect of improvement of the lacquer adhesion, film adhesion, corrosion resistance, and weldability by Ni increases the greater the content of Ni, so the amount of metal Ni in the Ni plating is preferably 5 mg/m$^2$ or more.

If the amount of metal Ni in the Ni plating exceeds 150 mg/m$^2$, the advantageous effects of improvement of the lacquer adhesion, film adhesion, corrosion resistance, and weldability become saturated. Ni is an expensive metal, so plating by over 150 mg/m$^2$ of Ni is disadvantageous economically. For this reason, the amount of metal Ni in the Ni plating is preferably not more than 150 mg/m$^2$.

When applying Ni diffusion plating, after applying the Ni plating, diffusion treatment is performed in an annealing furnace to form an Ni diffusion layer. Before, after, or simultaneously with the Ni diffusion treatment, nitriding may also be applied. In the case of applying nitriding, the advantageous effect of Ni as Ni plating and the advantageous effect of nitriding can both be obtained.

As the method of the Ni plating and Fe—Ni alloy plating, it is possible to utilize a known method generally used in electroplating.

The Sn plating is applied after the Ni-based plating is applied. The "Sn plating" referred to here is not just a plating by metal Sn, but also includes cases where the metal Sn is contaminated by unavoidable impurities or the metal Sn has trace amounts of elements added to it. The method of the Sn plating is not particularly limited. For example, it is also possible to use a known electroplating method, a method of plating by dipping the steel sheet in molten Sn, etc.

The Sn plating is formed for improving the corrosion resistance and weldability of the steel sheet. Sn itself has a high corrosion resistance, so either as metal Sn or as an alloy formed by tin melting treatment explained below, imparts to the steel sheet a superior corrosion resistance and weldability.

The corrosion resistance of Sn is remarkably improved when the amount of the metal Sn becomes 300 mg/m$^2$ or more. The greater the content of Sn, the greater the degree of improvement of the corrosion resistance. Therefore, the amount of metal Sn in the Sn plating is preferably 300 mg/m$^2$ or more. The advantageous effect of improvement of the corrosion resistance becomes saturated when the amount of metal Sn exceeds 3000 mg/m$^2$, so from the viewpoint of economy, the content of Sn is preferably 3000 mg/m$^2$ or less.

Further, the low electrical resistance Sn is soft, spreads by the Sn being pressed between the electrodes at the time of welding, and enables a stable current carrying region to be secured, so imparts particularly superior weldability. The advantageous effect of improvement of weldability appears when the amount of metal Sn is 100 mg/m$^2$ or more. Further, even if the amount of metal Sn becomes large, the advantageous effect of improvement of weldability does not become saturated.

Therefore, to improve the corrosion resistance and weldability, the amount of metal Sn is preferably made 300 mg/m$^2$ to 3000 mg/m$^2$.

After the Sn plating, tin melting treatment is applied. The tin melting treatment melts the Sn and alloys it with the Ni plating so as to form an Sn—Fe—Ni alloy and improve the corrosion resistance. It is also performed for forming islands of Sn alloy. The islands of Sn alloy can be formed by suitably controlling the tin melting treatment.

By the above treatment, it is possible to produce steel sheet having a plating structure not containing metal Sn, superior in paint and film adhesion, and with exposed Sn—Fe—Ni alloy plating.

The Ni plating, Sn plating, composite plating, or other inner plating may be formed at both surfaces of the steel sheet or, from the viewpoint of shaving production costs etc., may be formed on only one surface of the steel sheet.

<Regarding Method of Measurement of Ingredients in Inner Plating>

The amount of metal Ni and the amount of metal Sn in the inner plating, for example, can be measured by the fluorescent X-ray method. In this case, Ni-content samples with known amounts of metal Ni are used to prepare in advance a calibration curve relating to the amount of metal Ni and this calibration curve is used to identify the amount of metal Ni on a relative basis.

In the same way as the case of the amount of metal Sn, Sn content samples with known amounts of metal Sn are used to prepare in advance a calibration curve relating to the amount of metal Sn and this calibration curve is used to identify the amount of metal Sn on a relative basis.

As explained above, the steel sheet for container use of the present invention has, at least at one surface of the steel sheet, a chemical conversion coating film containing a mixture of a zirconium oxide compound and a zirconium phosphate compound. The zirconium oxide compound is segregated at part or all of a region of a depth of 40 to 100% from the surface of the chemical conversion coating film, while the zirconium phosphate compound is segregated at part or all of a region of a depth of 0 to 40% from the surface of the chemical conversion coating film.

The chemical conversion coating film, due to the low temperature cathodic electrolytic treatment, forms a layer structure of, in order from the steel sheet side, an oxide compound layer, copresence layer, and phosphate layer and exhibits a superior corrosion resistance and adhesion. Further, the steel sheet for container use of the present invention exhibits a superior canmaking ability. The chemical conversion coating film is formed by the low temperature cathodic electrolysis method, so becomes a dense, uniform coating film. The appearance of the steel sheet for container use is also excellent.

Above, suitable embodiments of the present invention were explained while referring to the attached drawings, but the present invention is not limited to the above embodiments needless to say.

EXAMPLES

Below, examples will be used to further explain the steel sheet for container use of the present invention. The examples shown below are merely illustrative examples of the present invention. The present invention is not limited by the examples shown below.

<Preparation of Steel Sheet>

First, the methods shown in the following (A1) to (A6) were used to prepare steel sheets provided with chemical conversion coating films.

(A1) Steel Sheet with No Inner Plating

Each steel sheet was cold rolled, then annealed and temper rolled to fabricate a steel base material having a thickness of 0.17 to 0.23 mm (steel sheet). The two surfaces were degreased and pickled.

(A2) Steel Sheet with Ni Plating (1)

Each steel sheet was cold rolled, then annealed and temper rolled to fabricate a steel base material having a thickness of 0.17 to 0.23 mm (steel sheet). The two surfaces were degreased and pickled. After this, the two surfaces were plated with Ni using a watt bath so as to prepare an Ni plated steel sheet.

(A3) Steel Sheet with Ni Plating (2)

Each steel base material cold rolled to a thickness of 0.17 to 0.23 mm (steel sheet) was plated on both surfaces with Ni using a watt bath. After this, the sheet was annealed to form an Ni diffusion layer, next, the sheet was degreased and pickled to produce an Ni plated steel sheet.

The obtained Ni plated steel sheet was measured for content of metal nickel by the fluorescent X-ray method.

(A4) Steel Sheet with Ni Plating+Sn Plating (Island-Shaped Sn Alloy) (1)

Each steel sheet was cold rolled, then annealed and temper rolled to fabricate a steel base material having a thickness of 0.17 to 0.23 mm (steel sheet). The two surfaces were degreased and pickled. After this, the two surfaces were plated with an Fe—Ni alloy using a sulfuric acid-hydrochloric acid bath, next were plated with Sn using a ferrostannic bath, and, furthermore, were treated by tin melting treatment to prepare Ni- and Sn-plated steel sheet having islands of Sn alloy.

(A5) Steel Sheet with Ni Plating+Sn Plating (Islands of Sn Alloy) (2)

Each steel base material cold rolled to a thickness of 0.17 to 0.23 mm (steel sheet) was plated on both surfaces with Ni using a watt bath. After this, the sheet was annealed to form an Ni diffusion layer, next, the sheet was degreased and pickled to produce an Ni plated steel sheet. After this, a ferrostannic bath was used to apply Sn plating, next, tin melting treatment was applied to prepare an Ni- and Sn-plated steel sheet having islands of Sn alloy.

(A6) Steel Sheet with Sn Plating

Each steel sheet was cold rolled, then annealed and temper rolled to fabricate a steel base material having a thickness of 0.17 to 0.23 mm (steel sheet). This was degreased and pickled. After this, the two surfaces were plated with Sn using a ferrostannic bath, next, were treated by a tin melting treatment to prepare an Sn plated steel sheet having an Sn alloy.

The obtained steel sheets were measured for contents of metal nickel and metal tin by the fluorescent X-ray method.

<Formation of Chemical Conversion Coating Film>

Next, the surfaces (two surfaces) of the steel sheets prepared by the methods of (A1) to (A6) were formed with chemical conversion coating films 30 by cathodic electrolysis using the chemical conversion solutions of the ingredients shown in the following Table 2 and the method of (B1) or (B2). The solution temperature of the chemical conversion treatment solution was 30° C., the pH was 3.5, and the electrolytic current density was made 3.0 A/dm$^2$.

TABLE 2

| Ion type (ppm) | B1 | B2 | B3 |
|---|---|---|---|
| Zr | 1400 | 1400 | 5000 |
| PO4 | 900 | 700 | — |
| T · F | 1800 | 1900 | 6500 |
| $NO_3$ | 1600 | 2500 | — |
| $NH_4$ | 1000 | 600 | — |
| Tannic acid | — | 1000 | — |

(B1) Steel sheets prepared by the methods of the above (A1) to (A6) were dipped in a treatment solution comprised of distilled water in which zirconium fluoride and phosphoric acid were dissolved, treated by cathodic electrolysis, then rinsed and dried.

(B2) Steel sheets prepared by the methods of the above (A1) to (A6) were dipped in a treatment solution comprised of distilled water in which zirconium fluoride, phosphoric acid, and tannic acid were dissolved, treated by cathodic electrolysis, then rinsed and dried.

The prepared by the above methods were measured for amounts of metal Zr and P in the chemical conversion coating film by quantitative analysis using the fluorescent X-ray method.

<Methods of Evaluation of Performance>

The steel sheets for container use prepared by the above methods were used as test samples. The test samples were evaluated for corrosion resistance, rustproofness, workability, weldability, lacquer adhesion, film adhesion, and appearance.

Below, the specific evaluation methods and evaluation criteria will be explained.

(1) Corrosion Resistance

Each test sample was coated on one surface with an epoxy-phenol resin, then was baked by holding it under temperature conditions of 200° C. for 30 minutes. The part coated with the resin was cross-cut to a depth reaching the steel base material, then was immersed in a test solution comprised of a mixture of citric acid (1.5 mass %) and salt (1.5 mass %) under temperature conditions of 45° C. for 72 hours and was washed and dried. After this, a tape peeling test was performed. The corrosion resistance was evaluated by the state of corrosion under the coating film of the cross-cut part (epoxy resin film) and the state of corrosion of the plate part.

Samples where the test resulted in no corrosion being observed under the coating film were evaluated as "A", samples where it resulted in slight corrosion of an extent not causing a practical problem being observed under the coating film were evaluated as "B", samples where it resulted in slight corrosion being observed under the coating film were evaluated as "C", and samples where it resulted in remarkable corrosion being observed under the coating film or corrosion being observed at the plate parts were evaluated as "D".

(2) Rustproofness

Each test sample was subjected to a cycle test, comprised of repeated holding for 2 hours in an environment of a humidity of 90% and holding for 2 hours in an environment of a humidity of 40%, for a two-month period and then evaluated for the state of rusting.

Samples where the test resulted in no rust at all were evaluated as "A", samples where it resulted in very slight rust of an extent not causing a practical problem were evaluated as "B", samples where it resulted in slight rust were evaluated as "C", and samples where it resulted in rust in the majority of the parts were evaluated as "D".

(3) Workability

Each test sample had a PET film of a thickness of 20 μm laminated on its two surfaces at 200° C., then was drawn and ironed for canmaking step by step and was evaluated for shapeability.

Samples where the test resulted in no breakage or flaws occurring and in extremely good shapeability were evaluated as "A", samples where it resulted in some breakage and flaws occurring were evaluated as "B", and samples where it resulted in breakage during processing and consequent inability of processing were evaluated as "C".

(4) Weldability

Each test sample was welded using a wire seam welder under conditions of a welding wire speed of 80 m/minute and a different current. The weldability was evaluated from the broadness of the range of suitable current comprised of a minimum current value giving sufficient welding strength (4000 A or less) and a maximum current value where dust and welding spatter and other welding flaws began to become noticeable (5000 A or more).

Samples where the test resulted in a broad range of suitable current and extremely good weldability were evaluated as "A", samples where it resulted in a narrow range of suitable current were evaluated as "B", and samples where it resulted in an inability of welding were evaluated as "C".

(5) Lacquer Adhesion

Each test sample was coated on one surface with an epoxy phenol resin, then was baked by holding it under temperature conditions of 200° C. for 30 minutes. After this, the part coated with the resin was cut to a depth reaching the steel base material at 1 mm intervals for a cross-cut shape, then was covered with adhesive tape and the tape peeled off in a cross-cut test.

Samples where the test resulted in no peeling at all were evaluated as "A", samples where it resulted in very slight peeling of an extent not causing a practical problem were evaluated as "B", and samples where it resulted in the major part being peeled off were evaluated as "D".

(6) Film Adhesion

Each test sample had a PET film of a thickness of 20 μm laminated on its two surfaces at 200° C., then was drawn and ironed for canmaking. After this, the can body was retort treated at 125° C. for 30 minutes. The film adhesion was evaluated by the state of peeling of the film at that time.

Samples where the test resulted in no peeling at all were evaluated as "A", samples where it resulted in very slight peeling of an extent not causing a problem in practical use were evaluated as "B", and samples where it resulted in peeling at the majority of the parts were evaluated as "C".

(7) Appearance

Each test sample was visually examined and was evaluated for appearance by the state of unevenness of the zirconium coating film, phosphate coating film, and phenol resin coating film.

Samples where the test resulted in no unevenness at all were evaluated as "A", samples where it resulted in very slight unevenness of an extent not causing a problem in practical use were evaluated as "B", and samples where it resulted in remarkable unevenness were evaluated as "C".

(8) Island Sn State

The state of islands of Sn when performing Sn plating after Ni-based plating was found by examining the surface by an optical microscope and evaluating the islands of Sn.

Samples where islands were formed overall were evaluated as "A", samples where there were parts where no islands were formed were evaluated as "B", and samples where no islands were formed were evaluated as "C".

(9) Segregated State of Zirconium Phosphate Compound

After formation of the chemical conversion coating film, each sample was analyzed by XPS. Samples with a coating film where zirconium phosphate compounds were segregated at a thickness part of within 40% from the surface for the total thickness of the chemical conversion coating film were evaluated as "A", while samples where zirconium phosphate compounds were segregated at the thickness part of within 40% from the surface were evaluated as "B".

(10) Segregated State of Zirconium Oxide Compound

After formation of the chemical conversion coating film, each sample was analyzed by XPS. Samples with a coating film where zirconium oxide compounds were segregated at a region of a depth of 40% to 100% from the surface for the total thickness of the chemical conversion coating film were evaluated as "A", while samples where zirconium oxide compounds were segregated at a region of a depth of 40 to 100% from the surface were evaluated as "B".

The amounts of Zr and amounts of P contained in the chemical conversion coating films were found by quantitative analysis by the fluorescent X-ray method.

The above test results are shown in Table 3 and Table 4. Table 3 and Table 4 show the amounts of metal Ni and the amounts of metal Sn in the inner platings in the test materials and the contents of Zr and contents of P in the chemical conversion coating films.

The amount of metal Ni and the amount of metal Sn shown in Table 3 and Table 4 are values found by the fluorescent X-ray measurement method, while the contents of Zr and contents of P in the coating films are values found by quantitative analysis by the fluorescent X-ray method.

TABLE 3

| | | Surface treated layer | | | Zr, phosphate coating film | | | Evaluation | |
|---|---|---|---|---|---|---|---|---|---|
| | No. | Treatment method | Ni am't (mg/m$^2$) | Sn am't (mg/m$^2$) | Treatment method | Zr content (mg/m$^2$) | P content (mg/m$^2$) | Corrosion resistance | Rustproofness |
| Inv. ex. | 1 | A1 | — | — | B1 | 8.9 | 4.2 | B | B |
| | 2 | A1 | — | — | B2 | 8.3 | 5.4 | B | B |
| | 3 | A1 | — | — | B1 | 7.7 | 3.2 | B | B |
| | 4 | A2 | 150 | — | B1 | 9 | 8 | A | A |
| | 5 | A2 | 1000 | — | B1 | 5.8 | 2.4 | A | A |
| | 6 | A2 | 500 | — | B1 | 8.9 | 7.9 | A | A |
| | 7 | A2 | 500 | — | B1 | 1.1 | 0.5 | B | B |
| | 8 | A3 | 150 | — | B1 | 7.2 | 3.9 | A | A |
| | 9 | A3 | 1000 | — | B1 | 6.2 | 3.1 | A | A |
| | 10 | A3 | 500 | — | B2 | 9 | 7.8 | A | A |
| | 11 | A3 | 500 | — | B2 | 1 | 0.5 | B | B |
| | 12 | A4 | 5 | 1000 | B1 | 6.4 | 3.1 | A | A |
| | 13 | A4 | 150 | 1100 | B1 | 7.6 | 5.3 | A | A |
| | 14 | A4 | 40 | 310 | B1 | 8.3 | 4.2 | A | A |
| | 15 | A4 | 40 | 2900 | B1 | 8.1 | 5.6 | A | A |
| | 16 | A4 | 40 | 2800 | B2 | 8.9 | 7.8 | A | A |
| | 17 | A4 | 5 | 300 | B2 | 1.1 | 0.5 | B | B |
| | 18 | A5 | 5 | 1100 | B1 | 7.1 | 4.6 | A | A |
| | 19 | A5 | 150 | 300 | B1 | 7.9 | 4.2 | A | A |
| | 20 | A5 | 50 | 3000 | B1 | 1 | 0.5 | A | A |

TABLE 3-continued

| | | | | | | | | |
|---|---|---|---|---|---|---|---|---|
| 21 | A5 | 50 | 1500 | B1 | 6.8 | 3.3 | A | A |
| 22 | A5 | 50 | 1000 | B2 | 9 | 7.9 | A | A |
| 23 | A5 | 150 | 300 | B2 | 8.9 | 4.9 | A | A |
| 24 | A6 | — | 560 | B1 | 9 | 7.8 | A | A |
| 25 | A6 | — | 5600 | B1 | 7.7 | 5.4 | A | A |

| | | Evaluation | | | | | | | |
|---|---|---|---|---|---|---|---|---|---|
| | No. | Work-ability | Weld-ability | Lacquer adhe-sion | Film ad-hesion | Appear-ance | Island Sn struc-ture | Segre-gation of phos-phate layer | Segre-gation of oxide com-pound layer |
| Inv. ex. | 1 | A | A | A | A | A to B | — | A | A |
| | 2 | A | A | A | A | A | — | A | A |
| | 3 | A | A | A | A | A | — | A | A |
| | 4 | A | A | A | A | A to B | — | A | A |
| | 5 | A | A | A | A | A | — | A | A |
| | 6 | A | A | A | A | A to B | — | A | A |
| | 7 | A | A | A | A | A | — | A | A |
| | 8 | A | A | A | A | A | — | A | A |
| | 9 | A | A | A | A | A | — | A | A |
| | 10 | A | A | A | A | A to B | — | A | A |
| | 11 | A | A | A | A | A | — | A | A |
| | 12 | A | A | A | A | A | A | A | A |
| | 13 | A | A | A | A | A | A | A | A |
| | 14 | A | A | A | A | A | A | A | A |
| | 15 | A | A | A | A | A | A | A | A |
| | 16 | A | A | A | A | A to B | A | A | A |
| | 17 | A | A | A | A | A | A | A | A |
| | 18 | A | A | A | A | A | A | A | A |
| | 19 | A | A | A | A | A | A | A | A |
| | 20 | A | A | A | A | A to B | A | A | A |
| | 21 | A | A | A | A | A | A | A | A |
| | 22 | A | A | A | A | A to B | A | A | A |
| | 23 | A | A | A | A | A to B | A | A | A |
| | 24 | A | A | A | A | A to B | — | A | A |
| | 25 | A | A | A | A | A | — | A | A |

TABLE 4

(Continuation of Table 3)

| | | Surface treated layer | | Zr, phosphate coating film | | | | Evaluation | |
|---|---|---|---|---|---|---|---|---|---|
| | No. | Treat-ment method | Ni am't ($mg/m^2$) | Sn am't ($mg/m^2$) | Treat-ment method | Zr content ($mg/m^2$) | P content ($mg/m^2$) | Corro-sion resis-tance | Rust-proof-ness |
| Inv. ex. | 26 | A6 | — | 2800 | B1 | 1 | 0.5 | B | B |
| | 27 | A6 | — | 3000 | B1 | 7.6 | 3.7 | A | A |
| | 28 | A6 | — | 2800 | B2 | 8.8 | 4.6 | A | A |
| | 29 | A6 | — | 2800 | B2 | 3.5 | 1.6 | B | A |
| Comp. ex. | 1 | A1 | — | — | B3 | 7.8 | — | D | C |
| | 2 | A1 | — | — | — | 0 | 0 | D | D |
| | 3 | A2 | 500 | — | B3 | 12.5 | — | C | C |
| | 4 | A2 | 100 | — | B3 | 8.6 | — | D | D |
| | 5 | A2 | 20 | — | B1 | 0.8 | 0.3 | D | D |
| | 6 | A3 | 550 | — | B3 | 3.3 | — | D | D |
| | 7 | A4 | 2 | 100 | B3 | 0.8 | — | D | C |
| | 8 | A4 | 10 | 250 | B2 | 0.5 | 0.2 | D | C |
| | 9 | A5 | 50 | 1000 | B3 | 8.1 | — | D | B |
| | 10 | A6 | — | 2800 | B3 | 7.6 | — | D | A |
| | 11 | A6 | — | 20 | B3 | 15.6 | 9.2 | D | C |

TABLE 4-continued (Continuation of Table 3)

| | No. | Evaluation | | | | | | | |
|---|---|---|---|---|---|---|---|---|---|
| | | Workability | Weldability | Lacquer adhesion | Film adhesion | Appearance | Island Sn structure | Segregation of phosphate layer | Segregation of oxide compound layer |
| Inv. ex. | 26 | A | A | A | A | A | — | A | A |
| | 27 | A | A | A | A | A | — | A | A |
| | 28 | A | A | A | A | A to B | — | A | A |
| | 29 | A | A | A | A | A | — | A | A |
| Comp. ex. | 1 | A | A | C | C | A | — | B | — |
| | 2 | A | A | D | C | A | — | — | — |
| | 3 | A | A | D | C | D | — | B | — |
| | 4 | A | A | C | C | A to B | — | B | — |
| | 5 | A | A | C | C | A | — | A | A |
| | 6 | A | A | C | C | A | — | B | B |
| | 7 | A | A | C | C | A | C | B | B |
| | 8 | A | A | C | C | A | A | B | B |
| | 9 | A | A | C | C | A | A | B | B |
| | 10 | A | A | C | C | A | — | B | B |
| | 11 | A | A | C | A | D | — | A | A |

As shown in Table and Table 4, Invention Examples 1 to 29 where the segregation of the zirconium phosphate compound or zirconium oxide compound was observed or the content of Zr or the content of P belongs to the range of the present invention were excellent in all of the evaluations of the above (1) to (10).

Comparative Examples 1 to 11 where the segregation of the zirconium phosphate compound or zirconium oxide compound could not be observed or the content of Zr or the content of P was outside the range of the present invention were inferior in the evaluations of the above (1) to (10) in comparison with the Invention Examples 1 to 29.

| Reference Signs List | |
|---|---|
| 10 | steel sheet for container use |
| 20 | steel sheet |
| 30 | chemical conversion coating film |
| 32 | oxide compound layer |
| 34 | phosphate layer |
| 36 | copresent layer |
| 40 | inner plating |

The invention claimed is:

1. A coated steel sheet for a container comprising:

a steel sheet coated on at least one side of the steel sheet with a chemical conversion coating film, the chemical conversion coating film having a thickness, and comprising an oxide compound layer, a phosphate layer, and a copresent layer;

wherein the oxide compound layer is present at a depth of 40 to 100% of the thickness of the chemical coating conversion film from the surface of the chemical conversion coating film, and is defined by an XPS analysis peak showing the presence of a zirconium oxide compound of the oxide compound layer, the zirconium oxide compound peak having a height at least two times the maximum noise height of the oxide compound layer in a spectral chart obtained by the XPS analysis;

the phosphate layer is present at a depth of 0 to 40% of the thickness of the chemical conversion coating film from the surface of the chemical coating conversion film, and is defined by an XPS analysis peak showing the presence of a zirconium phosphate compound of the phosphate layer, the zirconium phosphate compound peak having a height at least two times the maximum noise height of the phosphate layer in a spectral chart obtained by the XPS analysis; and the copresent layer is positioned between the oxide compound layer and the phosphate layer, wherein the zirconium oxide compound and the zirconium phosphate compound are copresent in the copresent layer.

2. The coated steel sheet as set forth in claim 1, wherein the zirconium oxide and zirconium phosphate compounds are present in the chemical conversion coating film, in an amount corresponding to 1 to 9 mg/m$^2$ zirconium metal.

3. The coated steel sheet as set forth in claim 1 or 2, wherein the chemical conversion coating film further comprises at least one phosphate compound in an amount corresponding to a concentration of phosphorous of 0.5 to 8 mg/m$^2$.

4. The coated steel sheet as set forth in claim 1 or 2, further comprising an inner plating comprising at least one of nickel and tin between the steel sheet and the chemical conversion coating film.

5. The coated steel sheet as set forth in claim 3, further comprising an inner plating comprising at least one of nickel and tin between the steel sheet and the chemical conversion coating film.

6. The coated steel sheet as set forth in claim 4, wherein the inner plating is nickel plating, and the nickel plating is present in an amount of corresponding to 150 to 1000 mg/m$^2$ of nickel.

7. The coated steel sheet as set forth in claim 5, wherein the inner plating is nickel plating, and the nickel plating is present, in an amount corresponding to 150 to 1000 mg/m$^2$ of nickel.

8. The coated steel sheet as set forth in claim 4, wherein the inner plating is tin plating, and the tin plating is present in an amount corresponding to 560 to 5600 mg/m$^2$ of tin.

9. The coated steel sheet as set forth in claim 5, wherein the inner plating is tin plating, and the tin plating is present, in an amount corresponding to 560 to 5600 mg/m$^2$ of tin.

10. The coated steel sheet as set forth in claim 4, wherein the inner plating is a nickel plating or an iron-nickel alloy plating, and further comprises a tin plating applied over the nickel plating or the iron-nickel alloy plating; wherein, at least a portion of the nickel plating or the iron-nickel alloy plating is alloyed with the tin plating to form a tin alloy plating containing islands of tin; and the inner plating contains nickel, in an amount corresponding to 5 to 150 mg/m$^2$ of nickel metal and tin, in an amount corresponding to 300 to 3000 mg/m$^2$ of tin metal.

11. The coated steel sheet as set forth in claim 5, wherein the inner plating is a nickel plating or an iron-nickel alloy plating, and further comprises a tin plating applied over the nickel plating or the iron-nickel alloy plating; wherein at least a portion of the nickel plating or the iron-nickel alloy plating is alloyed with the tin plating to form a tin alloy plating containing islands of tin; and the inner plating contains nickel, in an amount corresponding to 5 to 150 mg/m$^2$ of nickel metal and tin, in an amount corresponding to 300 to 3000 mg/m$^2$ of tin metal.

* * * * *